US011839272B2

(12) United States Patent
Yabuya et al.

(10) Patent No.: US 11,839,272 B2
(45) Date of Patent: Dec. 12, 2023

(54) SLIDER AND SLIDE FASTENER

(71) Applicant: YKK Corporation, Tokyo (JP)

(72) Inventors: Toru Yabuya, Toyama (JP); Norio Uozumi, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/910,691

(22) PCT Filed: Mar. 12, 2020

(86) PCT No.: PCT/JP2020/010922

§ 371 (c)(1),
(2) Date: Sep. 9, 2022

(87) PCT Pub. No.: WO2021/181632

PCT Pub. Date: Sep. 16, 2021

(65) Prior Publication Data

US 2023/0146827 A1 May 11, 2023

(51) Int. Cl.
*A44B 19/30* (2006.01)

(52) U.S. Cl.
CPC ..... *A44B 19/30* (2013.01)

(58) Field of Classification Search
CPC ..... A44B 19/30; A44B 19/26; A44B 19/308; Y10T 24/2561; Y10T 24/2582
See application file for complete search history.

(56) References Cited

U.S. PATENT DOCUMENTS 5,628,094 A 5/1997 Mizuno
5,898,979 A * 5/1999 Hamada ..... A44B 19/306 24/418
6,490,770 B1 * 12/2002 Matsuda ..... A44B 19/26 24/426
6,530,132 B2 * 3/2003 Yamagishi ..... A44B 19/26 24/415
7,059,024 B2 * 6/2006 Yoneoka ..... A44B 19/26 24/393
8,973,223 B2 * 3/2015 Blackford ..... A44B 19/34 24/415
2004/0154144 A1 8/2004 Yoneoka et al.

FOREIGN PATENT DOCUMENTS

EP 1036517 A1 9/2000
JP 09-37817 A 2/1997
JP 2000-262309 A 9/2000
JP 3379004 B2 2/2003
JP 4072951 B2 4/2008

OTHER PUBLICATIONS

International Preliminary Report on Patentability Translation received in corresponding International Application No. PCT/JP2020/010922, dated Sep. 22, 2022, in 7 pages.

* cited by examiner

*Primary Examiner* — Robert Sandy
(74) *Attorney, Agent, or Firm* — Procopio, Cory, Hargreaves & Savitch LLP

(57) ABSTRACT

In just one separate fastener stringer, a slider stops turning due to collision between a flange of the slider and a fastener element after turning in a direction a connecting pillar of the slider moves away from the fastener element provided in the just one separate fastener stringer. At this time point, an opposed tape side extending toward the flange forms an angle of less than or equal to 45° with respect to a center line of the slider.

12 Claims, 9 Drawing Sheets

[Fig. 1]
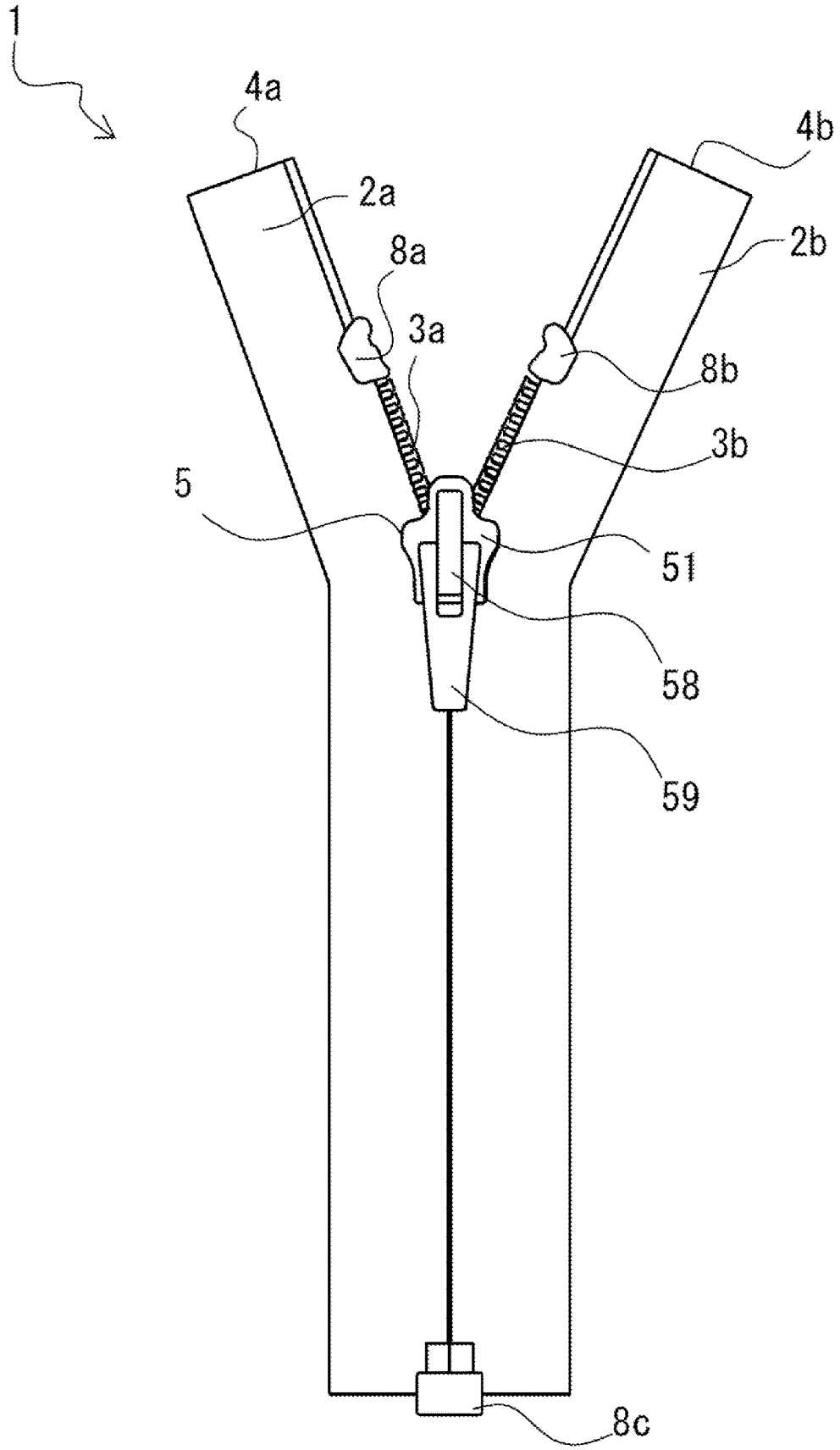

[Fig. 2]
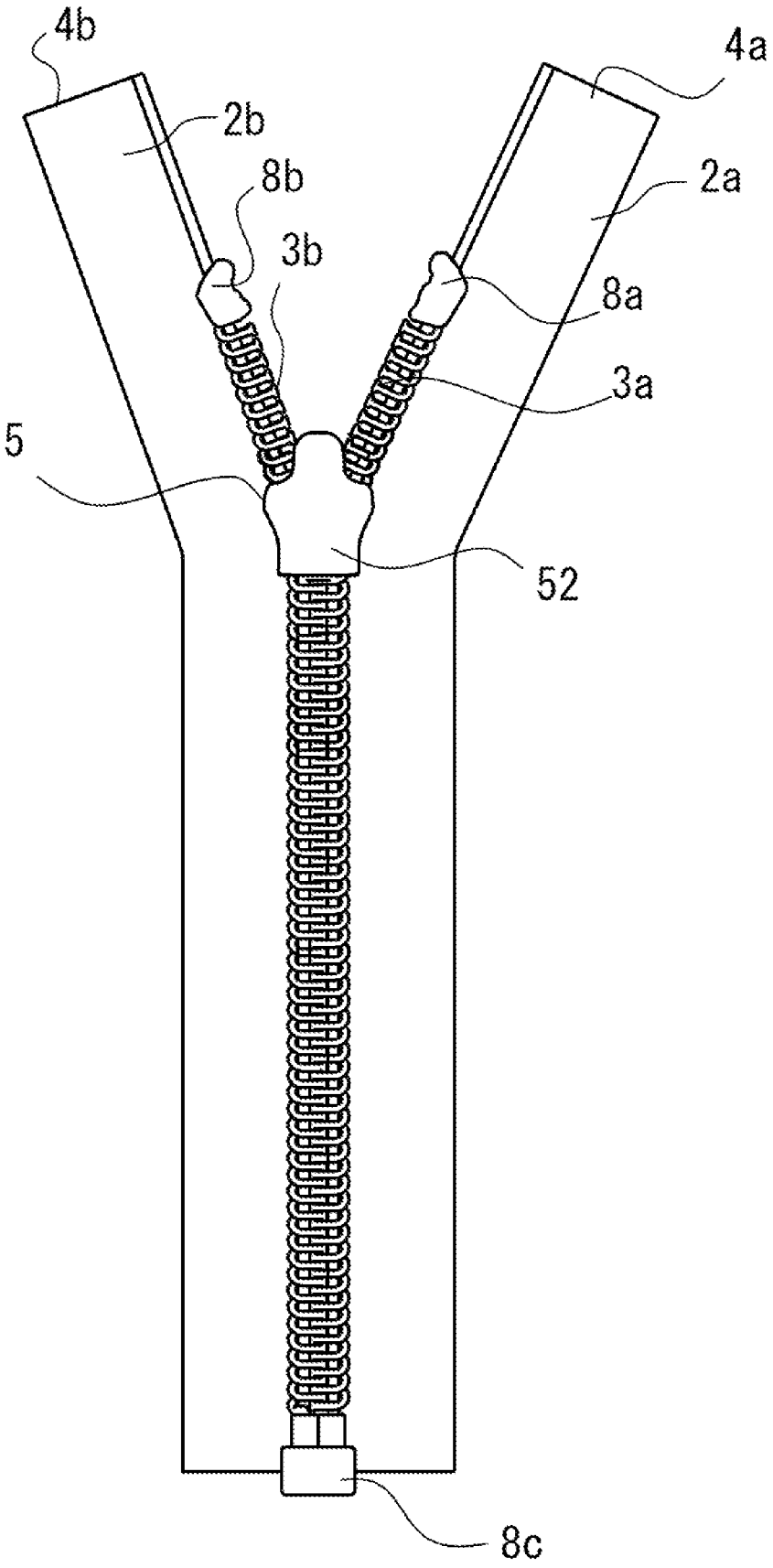

[Fig. 3]
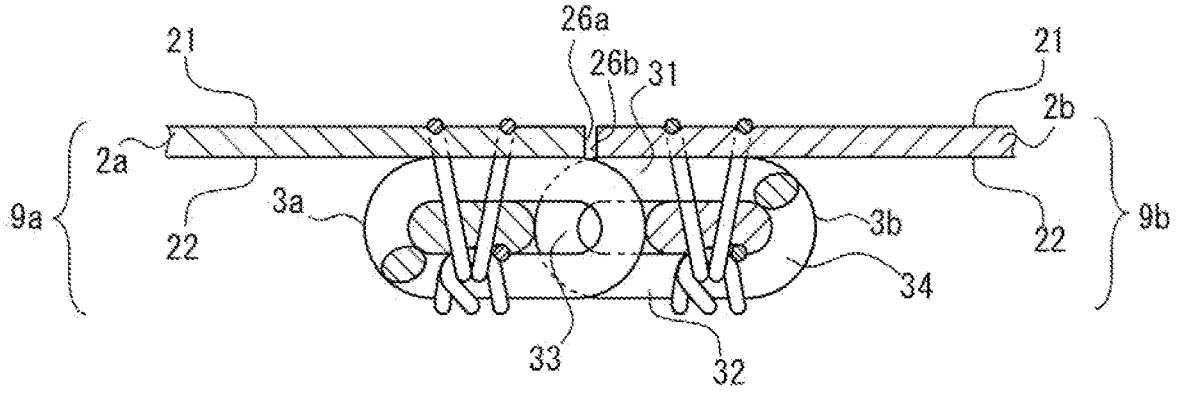

[Fig. 4]
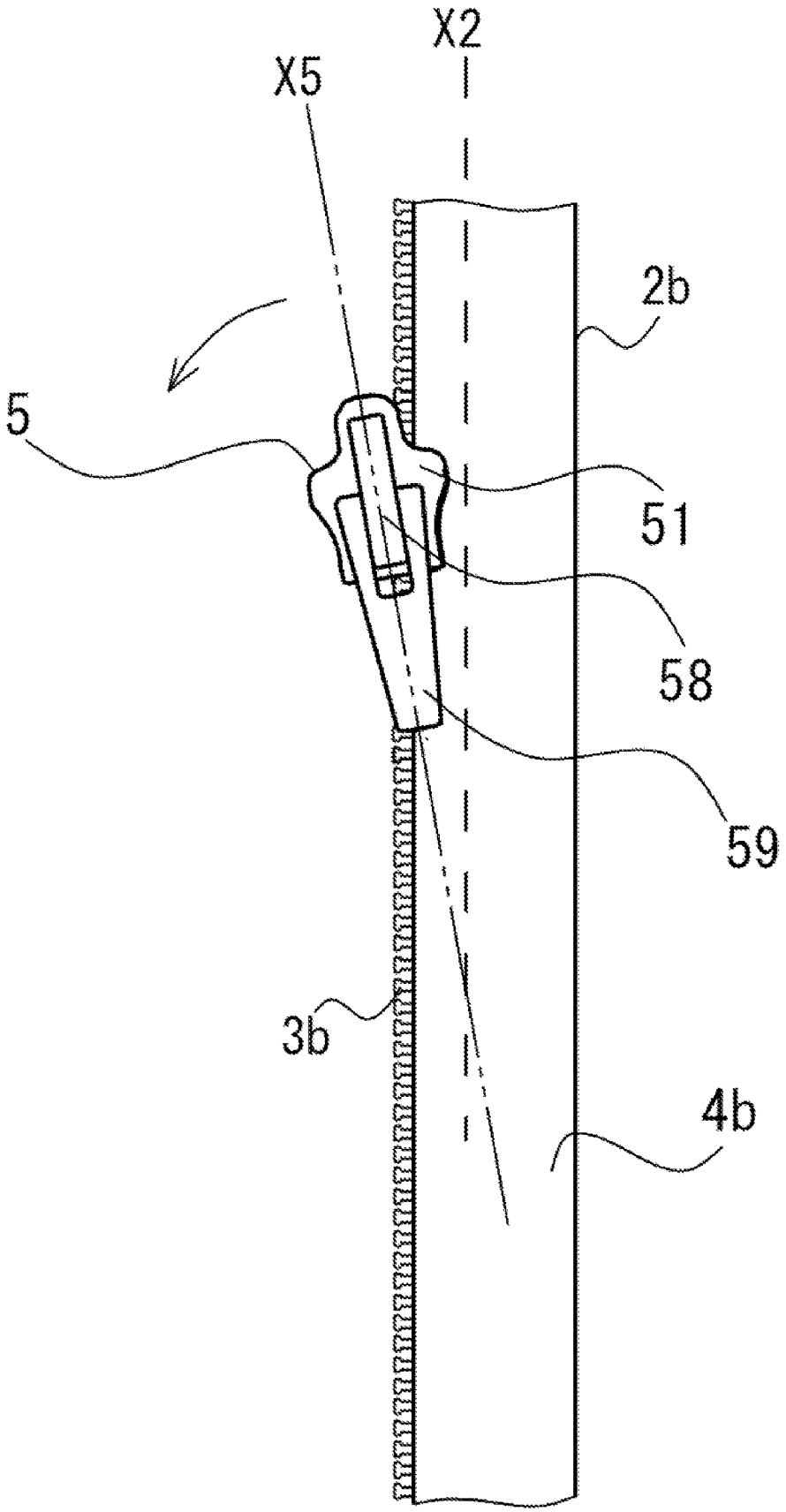

[Fig. 5]
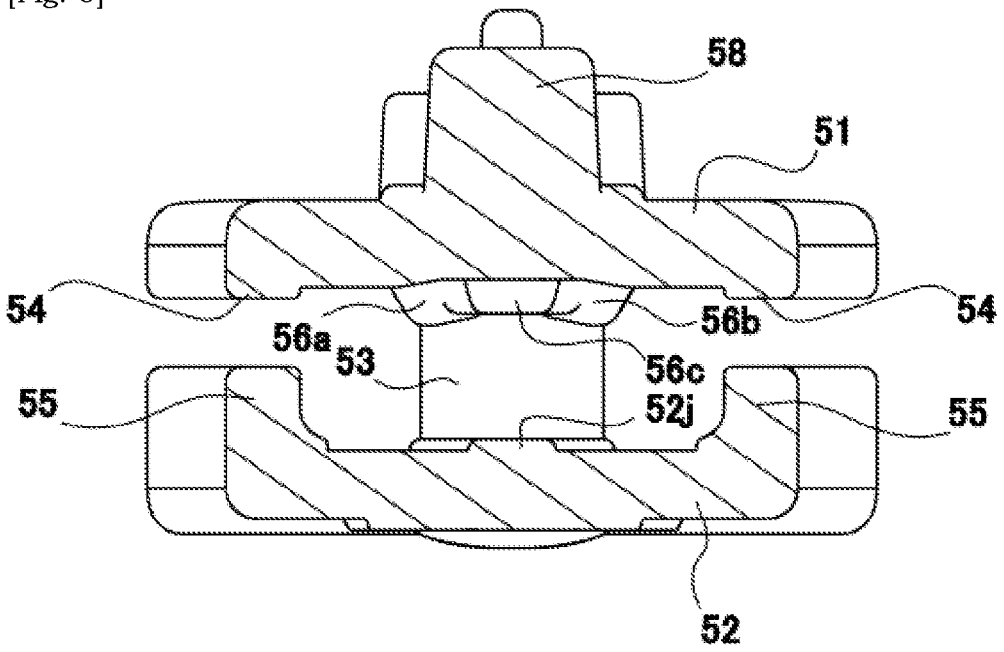
[Fig. 6]
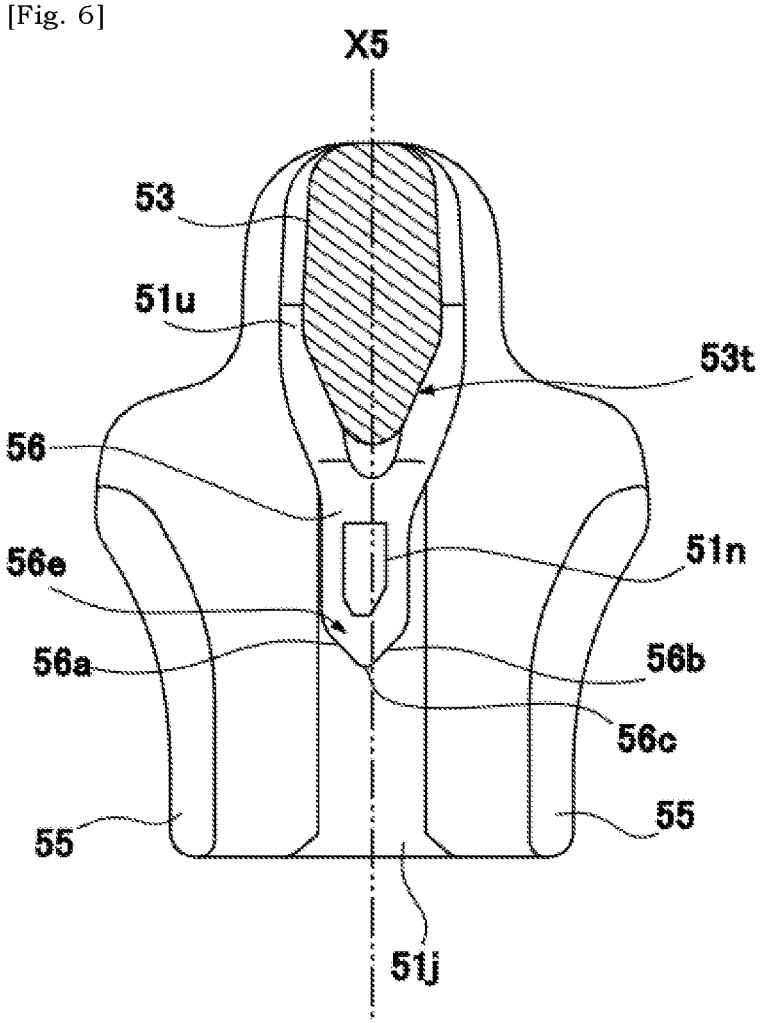

[Fig. 7]
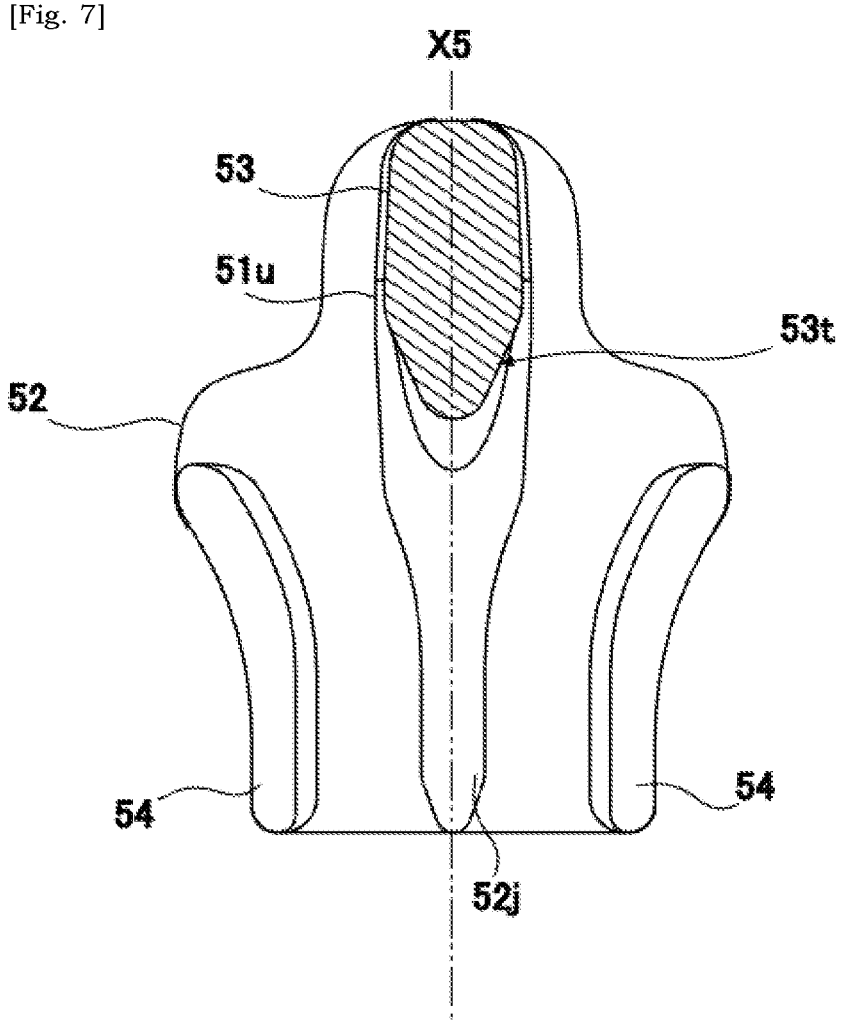

[Fig. 8]
(a)
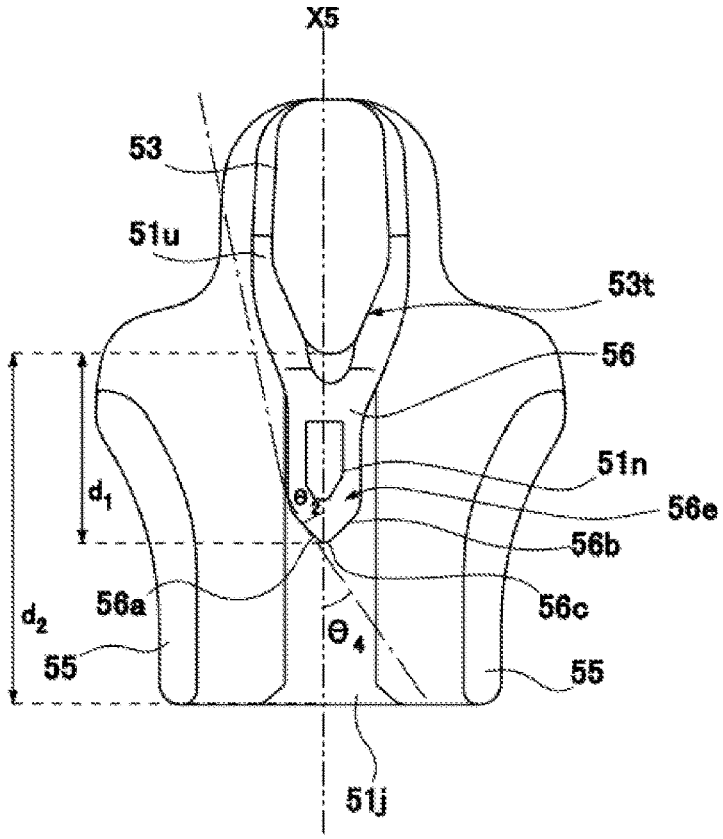
(b)
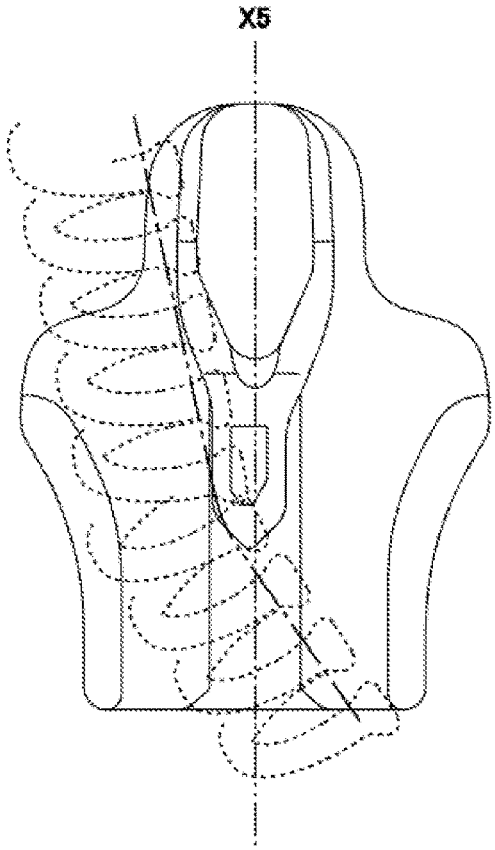

[Fig. 9]
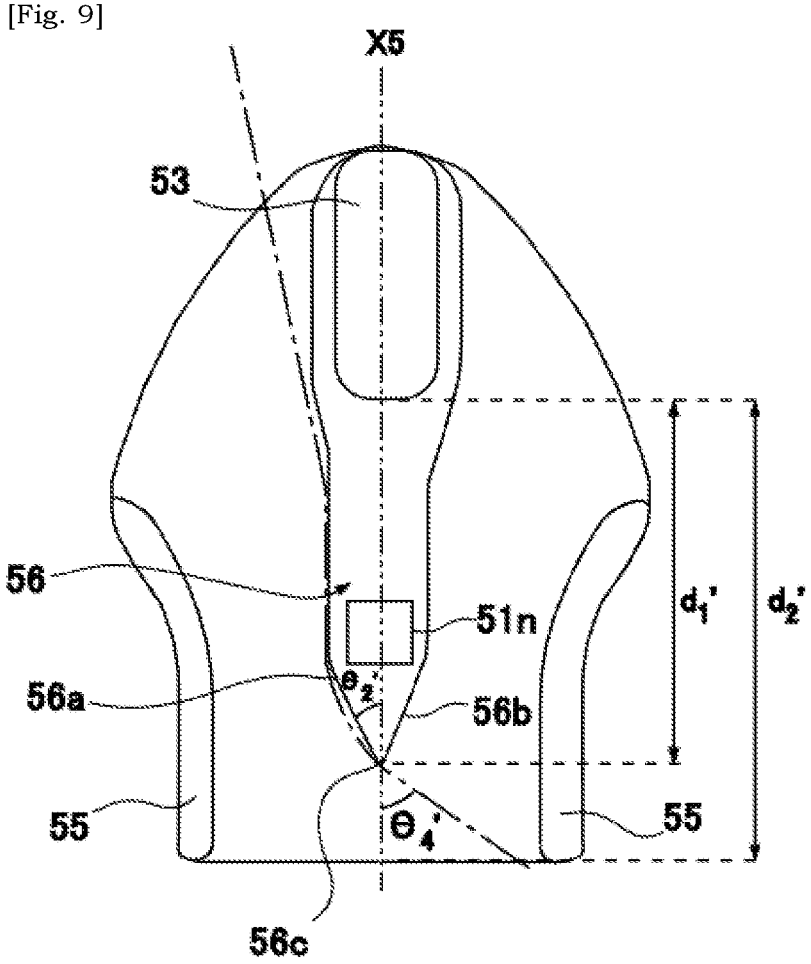
[Fig. 10]
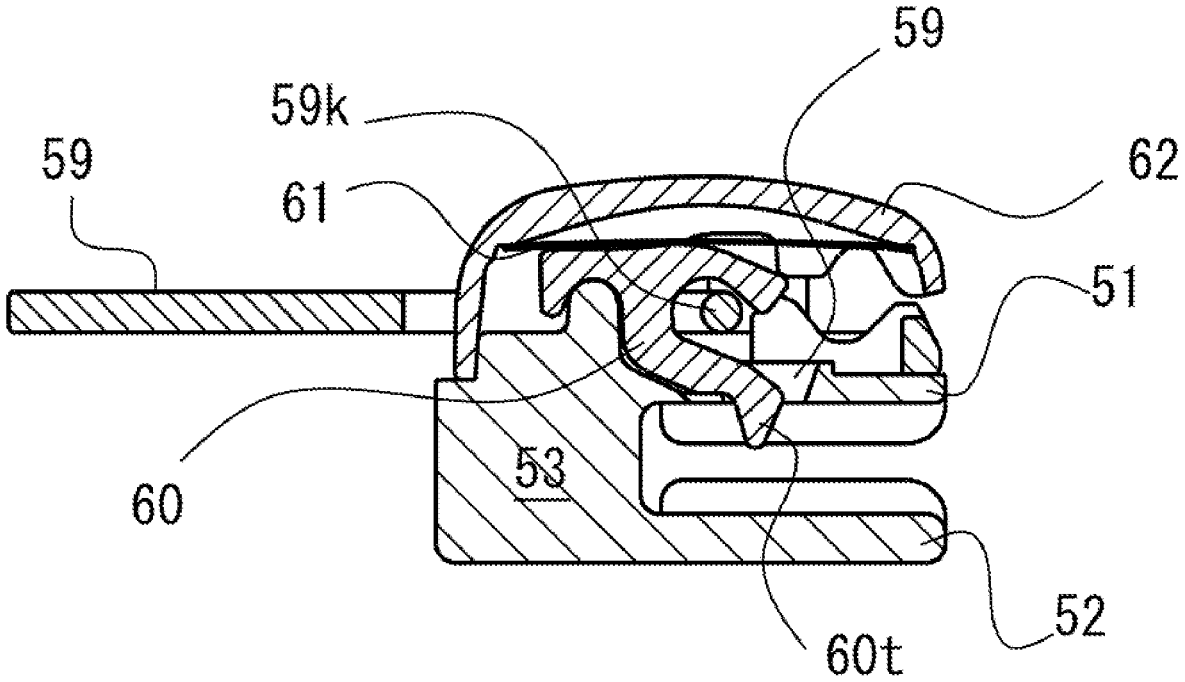

[Fig. 11]
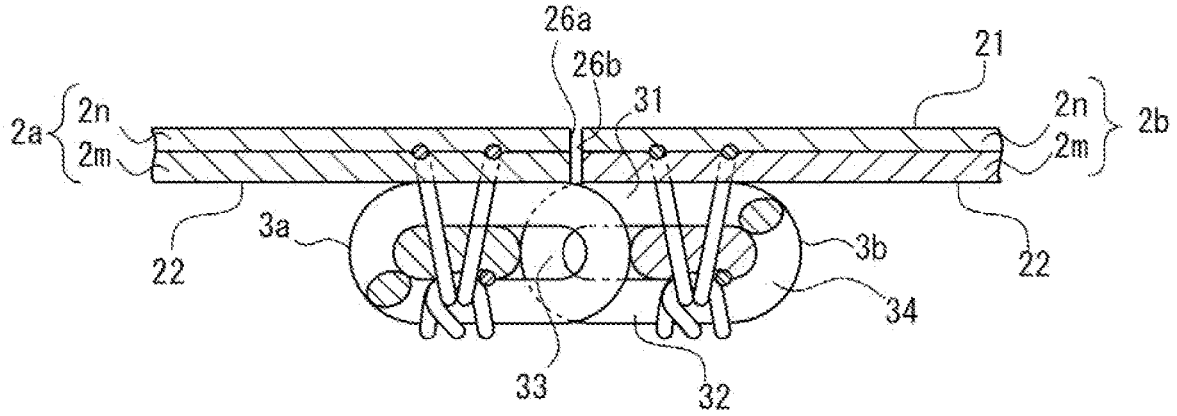

SLIDER AND SLIDE FASTENER

CROSS-REFERENCE TO RELATED APPLICATIONS

This application is a US national stage application of International Application PCT/JP2020/010922, filed Mar. 12, 2020, the contents of which are incorporated by reference.

TECHNICAL FIELD

The present disclosure relates to a slider and a slide fastener.

BACKGROUND ART

Patent literature 1 discloses that a top wing of slider is provided with a wedge-shaped elongated protrusion for spacing side-edges of fastener tapes. Similar structures are disclosed also in FIGS. 4 and 5 of Patent literature 2.

CITATION LIST

Patent Literature

[PTL 1] Japanese Patent No. 3379004
[PTL 2] Japanese Patent No. 4072951

SUMMARY

Technical Problem

In some instances, a slider of slide fastener is moved along a fastener element in just one separate fastener stringer at one side (hereinafter referred to just as "just one separate stringer") for a different purpose than decoupling and coupling a pair of fastener stringers. For example, when a slide fastener is sewn to clothes or the like, a slider could be an obstacle for the sewing work and may be moved along a fastener element in the just one separate stringer. There are cases where a slider is moved, just as play or killing time, in the just one separate stringer along the fastener element.

A structure of slider, particularly a structure for defining movement trajectories of fastener tape and fastener element (e.g. the wedge-shaped elongated protrusion in patent literature 1) is designed with a precondition that a slider is moved for a purpose of decoupling and coupling a pair of fastener stringers. The present inventors have newly recognized that a slider designed with the precondition may possibly be not suitably adapted to a situation where it moves in the just one separate stringer along the fastener element.

Solution to Problem

Slide fastener according to an aspect of the present disclosure includes a pair of fastener stringers each of which including a fastener tape and a fastener element arranged along one side-edge of the fastener tape; and a slider that moves forward to couple the pair of fastener stringers and moves rearward to decouple the pair of fastener stringers, the slider including a top wing, a bottom wing, a connecting pillar connecting the wings, and a flange arranged at the top wing or the bottom wing, wherein the top wing is provided with an elongated protrusion extending rearward so as to be interposed between opposed tape sides of the pair of fastener tapes and, in just one separate fastener stringer of the pair of fastener stringers, when the slider stops turning due to collision between the flange and the fastener element after turning in a direction the connecting pillar moves away from the fastener element provided in the just one separate fastener stringer, the opposed tape side extending toward the flange forms an angle of less than or equal to 45° with respect to a center line of the slider.

In some embodiments, the elongated protrusion has a rear end tapered to be narrower in width rearward, and an angle between a side surface of the rear end and the center line of the slider is greater than or equal to 45°.

In some embodiments, $d_1/d_2 \leq 0.7$ is satisfied in which $d_1$ denotes a length of the elongated protrusion, and $d_2$ denotes a distance of a rear end of the slider from the connecting pillar.

In some embodiments, in the just one separate fastener stringer, as the slider is pulled rearward while the slider stops turning as defined above, a side surface of a rear end of the elongated protrusion slides on the opposed tape side of the fastener tape of the just one separate fastener stringer.

In some embodiments, the bottom wing has a partition extending rearward from the connecting pillar in a manner to face at least partially the elongated protrusion.

In some embodiments, the fastener tape has a tape base fabric and a water-resistant layer formed on the tape base fabric, and the slider includes a locking pawl with a pawl end capable of projecting into a passage for fastener elements in the slider through a pawl aperture formed at the elongated protrusion.

Slide fastener according to another aspect of the present disclosure includes: a pair of fastener stringers each of which including a fastener tape and a fastener element arranged along one side-edge of the fastener tape; and a slider that moves forward to couple the pair of fastener stringers and moves rearward to decouple the pair of fastener stringers, the slider including a top wing, a bottom wing, a connecting pillar coupling the wings, and a flange arranged at the top wing or the bottom wing, a stack including the fastener tape and the fastener element being interposed between the top wing and the bottom wing, a top surface of the fastener tape being contactable with the top wing, and the fastener element arranged on a bottom surface of the fastener tape being contactable with the bottom wing, wherein the top wing is provided with an elongated protrusion extending rearward so as to be interposed between opposed tape sides of the pair of fastener tapes, and the elongated protrusion has a length such that the stack does not enter a space between the elongated protrusion and the bottom wing when, in just one separate fastener stringer of the pair of fastener stringers, the slider is pulled rearward while having been turned in a direction the connecting pillar moves away from the fastener element provided in the just one separate fastener stringer.

In some embodiments, $d_1/d_2 \leq 0.7$ is satisfied in which $d_1$ denotes the length of the elongated protrusion, and $d_2$ denotes a distance of a rear end of the slider from the connecting pillar.

In some embodiments, the elongated protrusion has a rear end tapered to be narrower in width rearward, and an angle between a side surface of the rear end and a center line of the slider is greater than or equal to 45°.

In some embodiments, the slider has been turned so that the flange of the slider is in contact with the fastener element of the just one separate fastener stringer.

A slider according to still another aspect of the present disclosure includes a top wing; a bottom wing; and a connecting pillar coupling the wings, wherein the top wing is provided with an elongated protrusion extending rearward so as to be interposed between opposed tape sides of a pair of fastener tapes to be separated or adjoined by the slider, $d_1/d_2 \leq 0.7$ is satisfied in which $d_1$ denotes a length of the elongated protrusion, and $d_2$ denotes a distance between the connecting pillar and a rear end of the slider, and the elongated protrusion has a rear end tapered to be narrower in width rearward, an angle between a side surface of the rear end and a center line of the slider being greater than or equal to 45°.

In some embodiments, the slider has a locking pawl with a pawl end capable of projecting into a passage for fastener elements in the slider through a pawl aperture formed at the elongated protrusion.

Advantageous Effects of Invention

According to an aspect of the present disclosure, it is facilitated to supply a slider suitably adapted to a situation where it moves in just one separate stringer along a fastener element.

BRIEF DESCRIPTION OF DRAWINGS

FIG. 1 is a top view of a slide fastener according to an aspect of the present disclosure.

FIG. 2 is a bottom view of the slide fastener according to an aspect of the present disclosure.

FIG. 3 is a schematic cross-sectional view of fastener stringers which are coupled.

FIG. 4 is a top view illustrating that a slider is placed in an intermediate position along a fastener element in just one separate stringer.

FIG. 5 is a schematic cross-sectional view of a slider.

FIG. 6 is a schematic view illustrating an inner surface of a top wing of slider.

FIG. 7 is a schematic view illustrating an inner surface of a bottom wing of slider.

FIG. 8 is a reference diagram for illustration of technical effect based on shortened length of elongated protrusion on a top wing of slider. Dash-dot lines indicates position and trajectory of an opposed tape side.

FIG. 9 is a reference diagram with respect to a slider shown in FIG. 2 of the patent literature 1.

FIG. 10 is a schematic illustration of schematic configuration of non-limiting exemplary slider with automatic stop function.

FIG. 11 is a schematic view of embodiment where a fastener tape is a water resistant tape.

DESCRIPTION OF EMBODIMENTS

Hereinafter, various embodiments and features will be described with reference to FIGS. 1 to 11. A skilled person would be able to combine respective embodiments and/or respective features without requiring excess description, and would appreciate synergistic effects of such combinations. Overlapping description among the embodiments are basically omitted. Referenced drawings aim mainly for describing inventions and are simplified for the sake of convenience of illustration. The respective features should be appreciated as universal features not only effective to slide fasteners and sliders presently presented but also effective to other various slide fasteners and sliders not presented in the present specification.

As shown in FIG. 1, a slide fastener 1 has a pair of left and right fastener stringers 4*a* and 4*b*. These stringers 4*a* and 4*b* are coupled as a slider 5 moves forward, and are decoupled (separated) as the slider 5 moves rearward. Each stringer 4*a*, 4*b* has a fastener tape 2*a*,2*b* and a fastener element 3*a*,3*b* arranged at one side-edge of the fastener tape 2*a*,2*b*. In the present specification, front-rear direction would be understood based on the movement of the slider 5. Up-down direction is orthogonal to the front-rear direction, and also is orthogonal to tape surfaces of the fastener tape (by which a thickness of the fastener tape is defined). Left-right direction is orthogonal to the front-rear direction and the up-down direction.

The fastener tape 2*a*,2*b* is a single-layer or multi-layer thin flexible member with top and bottom tape surfaces 21 and 22 defining a thickness thereof (see FIG. 3). The fastener tape may include a tape base fabric including a knitted structure or woven structure or mixture thereof. The knitted structure has higher elasticity or softness than the woven structure, and thus it is expected that it moves more easily (e.g. locally) following the motion of fastener element arranged the fastener tape.

The fastener element 3*a*,3*b* is a coil-like element made of a spirally wound mono-filament, and sewn to the tape surface 22 of the fastener tape 2*a*,2*b* by an attachment yarn. The fastener element 3*a*,3*b* is covered and concealed by the fastener tape 2*a*,2*b* from above in a coupled state of the slide fastener 1 (i.e. not or hardly viewable for human eyes). Note that, the extent of concealment of the fastener element 3*a*,3*b* by the fastener tape 2*a*,2*b* can be adjustable. Furthermore, when the slide fastener 1 is viewed from below as illustrated in FIG. 2, the fastener element 3*a*,3*b* is not concealed by the fastener tape 2*a*,2*b* at all. The fastener element 3*a*,3*b* should not be limited to a coil-like element, but resin-made or metal-made elements may be used in envisioned embodiments.

The coil element is configured by a series of units consisting of an upper leg 31, a lower leg 32, a head 33 and a return portion 34 (See FIG. 3). The upper leg 31 is arranged to be in contact with the tape surface 22. The lower leg 32 is arranged apart from the tape surface 22. The head 33 extends along the up-down direction to couple the upper leg 31 and the lower leg 32, and has a wider filament-width compared with the filament-width of the upper leg 31 and the lower leg 32 in the front-rear direction. The return portion 34 extends to couple the upper leg 31 and the lower leg 32 in adjacent units. It is optional to arrange or not to arrange a core thread inside the spiral structure of the coil element.

The slide fastener 1 further has front stops 8*a*,8*b* arranged at the front end of the fastener element 3*a*,3*b* to prevent the slider 5 from moving forward, and a rear stop 8*c* that allows decoupling and separation of the fastener stringers 4*a* and 4*b*. In the separate fastener stringer 4*b* at one side (herein after referred to as just one separate stringer 4*b*) after separation of the fastener stringers 4*a* and 4*b*, the slider 5 may move forward or rearward along the fastener element 3*b* arranged thereon, as shown in FIG. 4. The slider 5 may be occasionally moved forward and rearward in the just one separate stringer 4*b* for a purpose of ensuring easier sewing of the slide fastener 1 to cloths or just for play or killing time, although such a movement does not cause decoupling and coupling of the fastener stringers 4*a* and 4*b*.

A center line X5 of the slider 5 is tilted relative to a line X2 that is parallel to the elongation direction of the just one separate stringer 4*b* (the front-rear direction). There are cases, when the slider 5 is pulled rearward in the just one separate stringer 4*b*, the slider 5 is further tilted relative to the just one separate stringer 4*b*, i.e. an angle between the line X2 and the center line X5 is increased. As described at the beginning, a structure of slider, particularly a structure for defining movement trajectories of fastener tape and fastener element is generally designed with a precondition that a slider is moved for a purpose of decoupling and coupling a pair of fastener stringers. The movement of the slider 5 in the just one separate stringer 4*b* is out of consideration so to speak, and there is a possibility that the slider 5 is not suitably adapted to that instance.

More detail discussion on the slider 5 will follow with reference to FIGS. 5-9. The slider 5 has a top wing 51, a bottom wing 52, a connecting pillar 53 that connects these wings 51 and 52, flanges 54 arranged at the top wing 51, and flanges 55 arranged at the bottom wing 52, and a pull-tab attachment portion 58 arranged on the top wing 51, and a pull tab 59 attached to the pull-tab attachment portion 58 (See FIGS. 1 and 4). Any material can be used for the slider 5, but it may be made of metal or resin or ceramic. The slider 5 may be produced by assembling a locking pawl 60 (optionally a leaf spring 61 and a cap 62 in addition) described below (See FIG. 10) to a slider body consisting of the top wing 51, the bottom wing 52, the connecting pillar 53, the flanges 54 and the flanges 55.

Y-shaped passage for fastener elements is formed by the top wing 51, the bottom wing 52 and the connecting pillar 53. The connecting pillar 53 extends in the up-down direction so as to separate the engaged fastener elements 3*a* and 3*b*. The connecting pillar 53 has a rear end 53*t* tapered to be narrower in width rearward. The flanges 54,55 are arranged such that respective or engaged fastener elements 3*a* and 3*b* move in intended trajectory in the passage for fastener elements. Stack 9*a*,9*b* including the fastener tape 2*a*,2*b* and the fastener element 3*a*,3*b* (See FIG. 3) is interposed between the top wing 51 and the bottom wing 52. The tape surface 21 of the fastener tape 2*a*,2*b* can be in contact with the top wing 51 (the inner surface thereof) and the flange 54. The tape surface 22 of the fastener tape 2*a*,2*b* can be in contact with the flange 55. The fastener element 3*a*,3*b* can be in contact with the bottom wing 52 (the inner surface thereof) and the flange 55.

The top wing 51 is provided with the elongated protrusion 56 extending rearward from the connecting pillar 53 so as to be interposed between opposed tape sides 26*a* and 26*b* of the pair of fastener tapes 2*a* and 2*b* (See FIG. 3). The elongated protrusion 56 has a rear end 56*e* tapered to be narrower in width rearward. Left and right side surfaces 56*a* and 56*b* of the rear end 56*e* gradually approach each other rearward. The side surface 56*a* touches the opposed tape side 26*a*, and the side surface 56*b* touches the opposed tape side 26*b*. Apex 56*c* of the rear end 56*e* is formed by the side surfaces 56*a* and 56*b*. As the slider 5 is pulled rearward, the elongated protrusion 56 enters an interspace between the opposed tape sides 26*a* and 26*b* of the fastener tapes 2*a* and 2*b*, facilitating smoother disengagement of the fastener elements 3*a* and 3*b* by the connecting pillar 53. Note that the opposed tape sides 26*a* and 26*b* are sides (side faces) of the fastener tapes 2*a* and 2*b*, and which are arranged to face each other when the fastener stringers 4*a* and 4*b* are to be decoupled or coupled by the slider 5.

The top wing 51 is provided with a shallow groove 51*j* extending rearward from the elongated protrusion 56, providing a space for the fastener tapes 2*a* and 2*b* to flee which are to be separated by the elongated protrusion 56. The top wing 51 is provided with an element-pushing portion 51*u*, suppressing displacement of the fastener elements 3*a* and 3*b* in the slider 5. The bottom wing 52 is provided with a convex partition 52*j* extending rearward from the connecting pillar 53 in a manner to face the elongated protrusion 56 so that a movement passage for the fastener elements 3*a* and 3*b* is partitioned. In a case where the partition 52*j* is arranged, there is a possibility that the space for the stack 9*b* to flee may be narrowed as the slider 5 moves in the just one separate stringer 4*b*. If the partition 52*j* were omitted, the stability of decoupling and coupling of the fastener stringers 4*a* and 4*b* by the slider 5 may possibly be lowered.

FIG. 8 shows a condition in the just one separate stringer 4*b* shown in FIG. 4 where the slider 5 has stopped turning due to collision between the left flange 55 (in particular, a rear end thereof) and the fastener element 3*b* after turning in a direction the connecting pillar 53 moves away from the fastener element 3*b* on the just one separate stringer 4*b* (in a counterclockwise direction when viewed from above (see an arrow in FIG. 4)). In FIG. 8, position and trajectory of the opposed tape side 26*b* is indicated by dash-dot lines.

In the present embodiment, the opposed tape side 26*b* extending toward the flange 54 (alternatively the flange 55 if the flange 54 is not provided) forms an angle of less than or equal to 45° (e.g. 44°, 43°, 42°, 41°, 40°, . . . (enumeration of intermediate values is omitted) . . . , 15°) with respect to the center line X5 of the slider 5 (See $\theta_4$). Additionally or alternatively, in some cases, the side surface 56*b* of the rear end 56*e* of the elongated protrusion 56 forms an angle of greater than or equal to 45° (e.g. 46°, 47°, 48°, 49°, 50°, . . . (enumeration of intermediate values is omitted) . . . , 75°) with respect to the center line X5 of the slider 5 (See $\theta_2$). In some cases, $\theta_2$ is set to be 90°. In those cases, the slider 5 may be suitably adapted to a situation where it moves in the just one separate stringer 4*b* along the fastener element 3*b*. For example, as the slider 5 is turned and pulled rearward relative to the just one separate stringer 4*b* as described above, it is suppressed that the fastener tape 2*b* rides onto the elongated protrusion 56 (i.e. the stack 9*b* enters a space between the elongated protrusion 56 and the bottom wing 52) and that the rearward motion of the slider 5 is prevented or hindered. Similar to the side surface 56*b*, the side surface 56*a* of the rear end 56*e* of the elongated protrusion 56 may form an angle of greater than or equal to 45° relative to the center line X5 of the slider 5, but should not be limited to this. Note that, as the slider 5 is turned and pulled rearward relative to the just one separate stringer 4*b* as described above, the side surface 56*b* of the rear end 56*e* of the elongated protrusion 56 slides on the opposed tape side 26*b* of the fastener tape 2*b* of the just one separate stringer 4*b*.

Usually, by forming the elongated protrusion 56 longer rearward, the fastener tapes 2*a* and 2*b* are moved apart in the left-right direction at a position farther from the connecting pillar 53 in advance, facilitating stable decoupling and coupling of the fastener stringers 4*a* and 4*b*. In the present embodiment, instead of forming the elongated protrusion 56 longer rearward, the length of the elongated protrusion 56 is set to be shorter. In particular, the elongated protrusion 56 has a length $d_1$ such that the stack 9*b* does not enter a space between the elongated protrusion 56 and the bottom wing 52 as, in the just one separate fastener stringer 4*b* of the pair of fastener stringers 4*a* and 4*b*, the slider 5 is pulled rearward while having been turned in a direction the connecting pillar 53 moves away from the fastener element 3*b* provided in the just one separate fastener stringer 4*b*. Accordingly, it is suppressed that the fastener tape 2*b* rides onto the elongated protrusion 56 (i.e. the stack 9*b* enters a space between the elongated protrusion 56 and the bottom wing 52) and that the rearward motion of the slider 5 is prevented or hindered. In cases where the elongated protrusion 56 extends rearward from the connecting pillar 53, the length $d_1$ of the elongated protrusion 56 is equal to a (maximum) distance of the rear end of the elongated protrusion 56 from the connecting pillar 53 and.

In some cases, $d_1/d_2 \leq 0.7$ is satisfied in which $d_1$ denotes a length of the elongated protrusion 56, and $d_2$ denotes a distance of a rear end of the slider 5 from the connecting pillar 53. In some instances, $d_1/d_2 \leq 0.65$ or $d_1/d_2 \leq 0.6$ is satisfied. It is envisaged that, by shortening the elongated protrusion 56, the condition of the angle between the opposed tape side 26*b* and the center line X5 of the slider 5 would be more easily satisfied.

In embodiments where a pawl aperture 51*n* is formed at the elongated protrusion 56 of the slider 5, if the fastener tape 2*b* rides onto the elongated protrusion 56 (i.e. the stack 9*b* enters a space between the elongated protrusion 56 and the bottom wing 52), the fastener tape 2*b* may possibly be pressed into the pawl aperture 51*n* and the tape surface 21 of the fastener tape 2*b* may be scraped and damaged. Such disadvantage may be avoided or suppressed by satisfying the condition of the angle between the opposed tape side 26*b* and the center line X5 of the slider 5.

Description will follow referring to FIG. 9 for a clearer understanding of the above-described feature. FIG. 9 is prepared with reference to FIG. 2 of the patent literature 1. Similar to FIG. 8, FIG. 9 shows a condition in the just one separate stringer 4*b* where the slider 5 has stopped turning due to collision between the flange 55 (in particular, a rear end thereof) and the fastener element 3*b* after turning in a direction the connecting pillar 53 moves away from the fastener element 3*b* on the just one separate stringer 4*b* (see an arrow in FIG. 4).

In a case of FIG. 9, the opposed tape side 26*b* extending toward the flange 54 (alternatively the flange 55 if the flange 54 is not provided) forms an angle of greater than 45° with respect to the center line X5 of the slider 5 (See $\theta_4'$). Similarly, the side surface 56*b* of the rear end 56*e* of the elongated protrusion 56 forms an angle of less than 45° with respect to the center line X5 of the slider 5 (See $\theta_2'$). In such a case, as the slider 5 is turned and pulled rearward relative to the just one separate stringer 4*b* as described above, the fastener tape 2*b* may possibly ride onto the elongated protrusion 56 (i.e. the stack 9*b* may possibly enter a space between the elongated protrusion 56 and the bottom wing 52) and the rearward motion of the slider 5 may be prevented or hindered.

The slider 5 may be one with automatic stop function. In this instance, the slider 5 includes a locking pawl 60 with a pawl end 60*t* capable of projecting into a passage for fastener elements in the slider 5 through a pawl aperture 51*n* formed at the top wing 51 (e.g. at the elongated protrusion 56). The locking pawl 60 may be arranged to be elastically displaceable between a locking position (locking posture) and an unlocking position (unlocking posture) in accordance with operation of the pull tab 59. For example, as illustrated in FIG. 10, a locking pawl 60, a leaf spring 61 for urging the locking pawl 60, and a cap 62 for accommodating these parts are provided. The locking pawl 60 has a pawl end 60*t* capable of projecting into the passage for fastener elements from a pawl aperture 51*n*. The pull tab 59 has an operating rod 59*k* that moves the locking pawl 60 to the unlocking position where the pawl end 60*t* does not project from the pawl aperture 51*n*, thus it is unlocked. When the pull tab 59 is released from one's hand, the locking pawl 60 is urged by the leaf spring 61 to return to the locking position. Various types are known for the locking pawl 60, and should not be limited to the illustrated examples. For example, in another case, the locking pawl 60 is formed by bending a leaf spring, and is secured to the top wing 51 such that the pawl end 60*t* of the locking pawl 60 projects from the pawl aperture 51*n*.

FIG. 11 illustrates an instance where the fastener tape 2*a*,2*b* is multi-layered. The fastener tape 2*a*,2*b* has a tape base fabric 2*m* and a water-resistant layer 2*n* formed on the tape base fabric 2*m*. The tape base fabric 2*m* includes a woven structure or knitted structure or mixture thereof. The water-resistant layer 2*n* is a resin layer (e.g. a transparent resin layer) formed onto the tape base fabric 2*m* through coating or laminating. The water-resistant layer 2*n* is a resin layer such as made of polyurethane, and having a lower softness than that of the tape base fabric 2*m*.

In an embodiments where the pawl aperture 51*n* is formed at the elongated protrusion 56 of the slider 5, if the fastener tape 2*b* rides onto the elongated protrusion 56 (i.e. the stack 9*b* enters a space between the elongated protrusion 56 and the bottom wing 52), the fastener tape 2*b* may possibly be pressed into the pawl aperture 51*n* and the tape surface 21 of the fastener tape 2*b* may be scraped and damaged. If the fastener tape 2*a*,2*b* has the water-resistant layer 2*n*, the water-resistant layer 2*n* may be scraped and damaged, and the commercial value of the slide fastener 1 and cloths with the slide fastener 1 would be deteriorated. Such outcome may be avoided or suppressed by satisfying the condition of the angle between the opposed tape side 26*b* and the center line X5 of the slider 5 as described above.

Based on the above teachings, a skilled person in the art would be able to add various modifications to the respective embodiments. Reference numerals in Claims are just for reference and should not be referred for the purpose of narrowly construing the scope of claims.

REFERENCE SIGNS LIST

2*a*,2*b* Fastener tape
3*a*,3*b* Fastener element
4*a*,4*b* Fastener stringer
5 Slider
51 Top wing
52 Bottom wing
53 Connecting pillar
56 Elongated protrusion
56*e* Rear end
56*a*,56*b* Side surfaces

The invention claimed is:

1. A slide fastener comprising:

a pair of fastener stringers each of which including a fastener tape and a fastener element arranged along one side-edge of the fastener tape; and a slider that moves forward to couple the pair of fastener stringers and moves rearward to decouple the pair of fastener stringers, the slider including a top wing, a bottom wing, a connecting pillar connecting said wings, and a flange arranged at the top wing or the bottom wing, wherein the top wing is provided with an elongated protrusion extending rearward so as to be interposed between opposed tape sides of the pair of fastener tapes and, in just one separate fastener stringer of the pair of fastener stringers, when the slider stops turning due to collision between the flange and the fastener element after turning in a direction the connecting pillar moves away from the fastener element provided in said just one separate fastener stringer, the opposed tape side extending toward the flange forms an angle of less than or equal to 45° with respect to a center line of the slider.

2. The slide fastener according to claim 1, wherein the elongated protrusion has a rear end tapered to be narrower in width rearward, and an angle between a side surface of the rear end and the center line of the slider is greater than or equal to 45°.

3. The slide fastener according to claim 1, wherein $d_1/d_2 \leq 0.7$ is satisfied in which $d_1$ denotes a length of the elongated protrusion, and $d_2$ denotes a distance of a rear end of the slider from the connecting pillar.

4. The slide fastener according to claim 1, wherein in said just one separate fastener stringer, as the slider is pulled rearward while the slider stops turning as defined in claim 1, a side surface of a rear end of the elongated protrusion slides on the opposed tape side of the fastener tape (2*b*) of said just one separate fastener stringer.

5. The slide fastener according to claim 1, wherein the bottom wing has a partition extending rearward from the connecting pillar in a manner to face at least partially the elongated protrusion.

6. The slide fastener according to claim 1, wherein the fastener tape has a tape base fabric and a water-resistant layer (2*n*) formed on the tape base fabric, and the slider includes a locking pawl with a pawl end capable of projecting into a passage for fastener elements in the slider through a pawl aperture formed at the elongated protrusion.

7. A slide fastener comprising:

a pair of fastener stringers each of which including a fastener tape and a fastener element arranged along one side-edge of the fastener tape; and a slider that moves forward to couple the pair of fastener stringers and moves rearward to decouple the pair of fastener stringers, the slider including a top wing, a bottom wing, a connecting pillar coupling said wings, and a flange arranged at the top wing or the bottom wing, a stack (9*a*,9*b*) including the fastener tape and the fastener element being interposed between the top wing and the bottom wing, a top surface (21) of the fastener tape being contactable with the top wing, and the fastener element arranged on a bottom surface of the fastener tape being contactable with the bottom wing, wherein the top wing is provided with an elongated protrusion extending rearward so as to be interposed between opposed tape sides of the pair of fastener tapes, and the elongated protrusion has a length such that the stack (9*b*) does not enter a space between the elongated protrusion and the bottom wing when, in just one separate fastener stringer of the pair of fastener stringers, the slider is pulled rearward while having been turned in a direction the connecting pillar moves away from the fastener element provided in said just one separate fastener stringer.

8. The slide fastener according to claim 7, wherein $d_1/d_2 \leq 0.7$ is satisfied in which $d_1$ denotes the length of the elongated protrusion, and $d_2$ denotes a distance of a rear end of the slider from the connecting pillar and.

9. The slide fastener according to claim 7, wherein the elongated protrusion has a rear end tapered to be narrower in width rearward, and an angle between a side surface of the rear end and a center line of the slider is greater than or equal to 45°.

10. The slide fastener according to claim 7, wherein the slider has been turned so that the flange of the slider is in contact with the fastener element of said just one separate fastener stringer.

11. A slider for slide fastener, the slider comprising:

a top wing;

a bottom wing; and a connecting pillar coupling said wings, wherein the top wing is provided with an elongated protrusion extending rearward so as to be interposed between opposed tape sides of a pair of fastener tapes to be separated or adjoined by said slider, $d_1/d_2 \leq 0.7$ is satisfied in which $d_1$ denotes a length of the elongated protrusion, and $d_2$ denotes a distance of a rear end of the slider from the connecting pillar, and the elongated protrusion has a rear end tapered to be narrower in width rearward, an angle between a side surface of the rear end and a center line of the slider being greater than or equal to 45°.

12. The slider according to claim 11, wherein the slider has a locking pawl with a pawl end capable of projecting into a passage for fastener elements in the slider through a pawl aperture formed at the elongated protrusion.

* * * * *